US005878954A

United States Patent [19]

Lyons

[11] Patent Number: 5,878,954

[45] Date of Patent: Mar. 9, 1999

[54] LIQUID DISPENSING DEVICE

[76] Inventor: Richard A. Lyons, 7301 N. Lafayette Rd., Indianapolis, Ind. 46278

[21] Appl. No.: 963,377

[22] Filed: Nov. 3, 1997

[51] Int. Cl.[6] ..... A47G 21/18; B65D 23/00

[52] U.S. Cl. ..... 239/24

[58] Field of Search ..... 239/24–33, 588, 239/333, 332; 222/383.1, 380, 383.2, 330, 333, 309

[56] References Cited

U.S. PATENT DOCUMENTS

| | | | |
|---|---|---|---|
| 1,062,786 | 6/1913 | Miller | 239/30 X |
| 3,669,319 | 6/1972 | Sanz | 222/309 |
| 3,741,449 | 6/1973 | Goda | 222/309 |
| 3,931,915 | 1/1976 | Dowwings et al. | 222/333 X |
| 3,940,019 | 2/1976 | Kross et al. | 222/309 |
| 4,655,123 | 4/1987 | Shrader | 222/383.1 X |
| 4,699,319 | 10/1987 | Green | 239/24 X |
| 5,058,779 | 10/1991 | Sundilla | 222/309 |
| 5,062,547 | 11/1991 | Zahner et al. | 222/333 |

*Primary Examiner*—Kevin Weldon
*Attorney, Agent, or Firm*—Daniel J. O'Connor

[57] ABSTRACT

A drinking tube for supplying fluid directly to a person having a limited ability to swallow. The drinking tube includes associated pump and pump control elements to provide fluid upon activation of a switch. The quantity of fluid supplied may be varied and the system may be repeatedly activated by the person to whom the fluid is directly supplied.

1 Claim, 1 Drawing Sheet

LIQUID DISPENSING DEVICE

BACKGROUND AND OBJECTS OF THE INVENTION

The present invention is generally related to the liquid dispensing arts and, in particular, to a system and method for supplying a controlled quantity of fluid to a person who is physically challenged.

The need for fluid supply to physically challenged persons has been generally described in the prior art as illustrated by U.S. Pat. No. 4,699,319.

The prior art has not shown or suggested a system which is specifically designed to supply a controlled quantity of liquid to a person to match the person's ability to swallow.

Accordingly, it is an object of the present invention to demonstrate a pump and switching system to supply a controlled quantity of fluid to a user of the device.

It is also an object of the invention to set forth a system designed for a person with limited ability to ingest or swallow liquids but who does have voluntary control of movement of some part of the body, for example, the ability to manually activate a control switch.

It is a further object of the invention to show a controlled quantity drinking device which may be easily and economically manufactured for widespread distribution as needed in the art.

It is a still further object of the invention to set forth a controlled quantity drinking system which is made of readily available components for economy of manufacture and ease of use.

These and other objects and advantages of the invention will be apparent to those of skill in the art from the description which follows.

PRIOR ART PATENTS AND DESIGNS

The prior art teaches many types of solid food feeding devices but few liquid delivery systems to supply fluid to a person for drinking.

U.S. Pat. No. 4,699,319, for example, shows the use of a flexible drinking straw by which a person can draw a supply of liquid.

The above system does not include a pump or means by which the quantity of dispensed liquid can be controlled for the needs of some persons.

In contrast, the present invention provides these needed components and functions and thus provides a solution for the drinking needs of certain persons.

SUMMARY OF THE INVENTION

The system includes a water bottle or container from which a drinking tube and mouthpiece are extended.

The drinking tube contains a liquid pump means and a check valve to prevent return of fluid if needed.

The pump is operated by a motor which is controlled by a switch, relay contacts and an adjustable interval timer relay.

Activation of the switch by the user causes the pump and motor to be operated for a certain selected time interval so that a controlled quantity of liquid is supplied to the user.

The person thus receives the needed amount of fluid, and no more than needed, via a single activation of the switch means.

The system thus provides assistance for the ingestion of the needed and proper amount of liquid.

The motor and timer circuit may be supplied power from either a direct or alternating current power source.

DESCRIPTION OF THE DRAWING FIGURE

The single drawing FIG. 1 shows the shows the system components and control circuit in schematic form to illustrate the apparatus and method of the invention.

DESCRIPTION OF A PREFERRED EMBODIMENT

Figure 1:
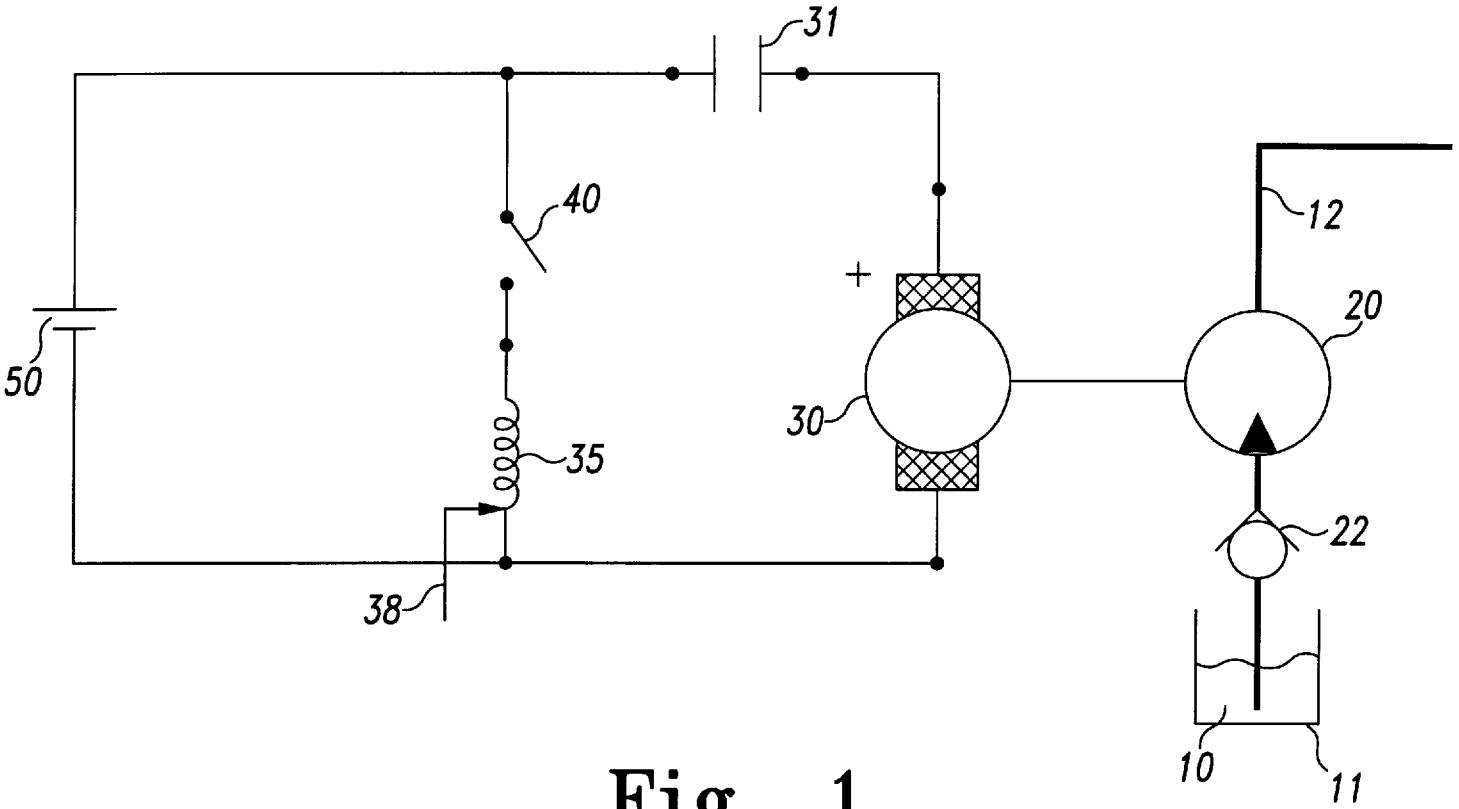

Referring to the drawing FIG. 1, a source of liquid 10 is supplied from a container or bottle 11 to a drinking tube 12 for the person using the system.

The drinking tube 12 has a liquid pump means 20 positioned therein and a check valve 22 to prevent return of liquid in system configurations where needed. The liquid pump means 20 is of a type known and readily available in the fluid mechanics arts.

Pump 20 is activated and controlled via a circuit which includes a motor 30 to drive the pump.

The circuit of motor 30 is completed by the activation of drink switch 40 and conventional relay contacts 31.

Also included in the circuit is an adjustable interval timer relay 35 which serves the purpose of timing the operation of pump motor 30. Timer relay 35 is manually adjustable via means indicated at numeral 38 in the drawing figure. Such adjustable interval timer relays are generally available and used in the electromechanical arts.

The drawing indicates a 12 volt DC motor 30 and a 12 volt DC power supply 50 although AC power and motor may also be utilized.

In operation of the system, a person requiring a controlled quantity of liquid 10 would activate the drink switch 40 by, for example, manual operation.

The pump motor circuit is thus completed and fluid is supplied to the user via drink tube 12.

The interval timer relay 35 controls the time of pump operation so that only a certain desired quantity of liquid is supplied to the person.

In order to receive a second quantity of liquid, the user would again activate the drink switch 40 thus preventing excess fluid from being supplied to the person. The cycle could then be completed as many times as needed by the user.

The interval timer relay may be adjusted via means shown at 38 to, in effect, increase or decrease the quantity of liquid supplied.

The system is thus highly useful for a person needing a certain limited quantity of liquid for ingestion and who does have voluntary control of movement of some part of the body.

The system enables the user to obtain their own needed liquid level without assistance from another—a feature which is highly beneficial in the art.

As previously noted, the motor, pump and relay system components of the invention are commercially available items so that the overall design may be mass-produced at a reasonable cost for widespread distribution.

Other equivalent electromechanical system components may be utilized and still fall within the intended broad scope of the invention which covers the use of a controlled quantity drinking device.

While a particular embodiment and system configuration has been shown and described, it is intended to cover all equivalent configurations and components which would reasonably occur to those of skill in the art.

The invention is further defined by the claims set forth hereinbelow.

I claim:

1. A controlled quantity drinking device means for supplying liquid directly to a person with limited swallowing ability, a source of liquid(10) and a container(1l) for said source of liquid, a drinking tube means(12) extending from said source of liquid, pump means(20) attached to said drinking tube, pump motor means(30) for activating said pump means and being connected to a power supply(50) and to a a control circuit, drink switch means(40) for controlling said pump motor, an interval timer relay(35) means for controlling the run time of said motor and to control the quantity of liquid dispensed to the person, wherein said interval timer relay means has adjustable means(38) wherein the amount of dispensed liquid may be varied or adjusted by controlling the run time of said pump(20) and said pump motor(30), said controlled quantity drinking device further including a check valve means(22) within said drinking tube(12), said drinking tube further including a mouthpiece portion for the person with limited swallowing ability, wherein said drink switch(40) is repeatedly operable by the person to provide repeated limited quantities of fluid directly to the person.

* * * * *